US006799924B1

(12) United States Patent
Kight et al.

(10) Patent No.: US 6,799,924 B1
(45) Date of Patent: Oct. 5, 2004

(54) SEGMENTED CONCRETE PILING ASSEMBLY WITH STEEL CONNECTING RODS

(75) Inventors: Robie L. Kight, Jackson, MS (US); Mack Chunn, Madison, MS (US)

(73) Assignee: Precision Piling Systems, LLC, Jackson, MS (US)

( * ) Notice: Subject to any disclaimer, the term of this patent is extended or adjusted under 35 U.S.C. 154(b) by 0 days.

(21) Appl. No.: 10/388,923

(22) Filed: Mar. 14, 2003

(51) Int. Cl.[7] ..... E02D 5/30

(52) U.S. Cl. ..... 405/251; 405/252; 405/256; 405/232

(58) Field of Search ..... 405/252, 251, 405/250, 256, 232, 231, 230

(56) References Cited

U.S. PATENT DOCUMENTS 3,238,732 A * 3/1966 Aas-Jakobsen ..... 405/252
3,625,012 A * 12/1971 Thorburn ..... 405/252
3,651,653 A * 3/1972 Mouton, Jr. et al. ..... 405/252
4,157,230 A * 6/1979 Tomt et al. ..... 405/252
4,735,527 A * 4/1988 Bullivant ..... 405/252
5,032,041 A * 7/1991 Sinnes ..... 405/252
5,096,333 A * 3/1992 Bassett ..... 405/252
5,288,175 A 2/1994 Knight ..... 405/230
5,505,561 A 4/1996 Willcox, III ..... 405/251
5,934,835 A * 8/1999 Whitty et al. ..... 405/252
6,543,967 B1 * 4/2003 Marshall ..... 405/252

* cited by examiner

*Primary Examiner*—Frederick L. Lagman
(74) *Attorney, Agent, or Firm*—Walker, McKenzie & Walker, P.C.

(57) ABSTRACT

A segmented piling system and a process of installing the system for supporting a structure on unstable soil. A first or starter pile segment is driven into the soil adjacent the structure. A connecting rod is inserted into the upper end of the starter pile segment. A second or follower pile segment is placed on the upper end of the starter pile segment, over the connecting rod, and driven into the soil, driving the starter pile segment further into the soil. That step is repeated with additional connecting rods and follower pile segments until the pile (i.e., the combination of pile segments and connecting rods) are driven the desired amount into the soil, whereupon the top of the pile is supportingly connected to the structure.

9 Claims, 4 Drawing Sheets

SEGMENTED CONCRETE PILING ASSEMBLY WITH STEEL CONNECTING RODS

BACKGROUND OF THE INVENTION

1. Field of the Invention

The present invention relates, in general, to segmented pre-cast concrete piling systems used for underpinning existing buildings.

2. Information Disclosure Statement

Pre-cast concrete piles have been in use for the purpose of supporting and/or leveling structures for a number of years. These piles are vertically stacked one upon another and driven into the soil to a point of refusal at which a load bearing capacity may be obtained. These segmented piles, installed properly, provide greater support than a shallow method of underpinning, however, there are problems with the existing art.

In unstable soils, there is great potential for upward, downward, and lateral movement. These factors affect the integrity of the pile, as existing segmented piles have no, or very little, lateral support to prevent separation of the pile segments thus causing misalignment, separation of the pile, and loss of support.

Another important factor with segmented piling systems is proper alignment during installation. With no, or very little, lateral support between segmented piles using existing procedures, it is difficult to insure proper alignment and prevention of lateral movement during, and after, installation.

Knight, U.S. Pat. No. 5,288,175, issued Feb. 22, 1994, discloses a continuously reinforced segmental precast concrete underpinning pile system including a plurality of precast concrete piles and a high strength wire strand joining each of the piles.

Willcox, U.S. Pat. No. 5,505,561, issued Apr. 9, 1996, discloses a self-piloting compressible piling system including a plurality of pre-formed pile sections having bores therethrough and adapted to be arranged in end-to-end relation such that the bores are concentrically collinear, an auger plate positioned beneath the lowest of the pile sections, and a tension-bearing cable attached to the auger plate and extending through the bores of the pile sections to load the pile sections and auger plate in compression.

Nothing in the known prior art, either singly or in combination, discloses or suggests the present invention.

BRIEF SUMMARY OF THE INVENTION

The present invention is intended for the purpose of repair and prevention of settlement of structures located on unstable soil. The present invention provides proper alignment of segmented piling system during installation, verification of depth during installation, prevention of lateral movement of the piling system during installation and throughout the life of the piling system. The increase in bending strength and lateral support in the piling system results in improved long term structural support for the building being supported.

A key concept of the present invention is to provide a system including a unique combination of a starter pile segment, a plurality of follower pile segments, and a plurality of connecting rods which allows the pile segments to be driven into the soil one pile segment at a time with each pile segment aligned, collinear and concentric with one another.

The present invention relates to a segmented pre-cast concrete piling system used for underpinning existing buildings. The piling system of the present invention provides a continuous connection of components for vertical and horizontal control of the piling itself during installation and throughout the life of the piling. The significant improvement of the present invention over the prior art is the increased lateral support and bending strength of the piling system provided by installation of steel connecting rods interconnecting segmented concrete pilings. The significant increase in bending strength of the piling system provides for improved vertical support of an existing structure.

It is an object of the present invention to provide a segmented piling system for underpinning existing buildings, including a plurality of segmented piles with each pile interconnected by connecting rods.

DETAILED DESCRIPTION OF THE INVENTION

A first preferred embodiment of the segmented piling system of the present invention is shown in FIGS. 4–6 and 15, and identified by the numeral 11. The piling system 11 is designed for supporting an existing building B or other structure on unstable soil S.

Figure 7:
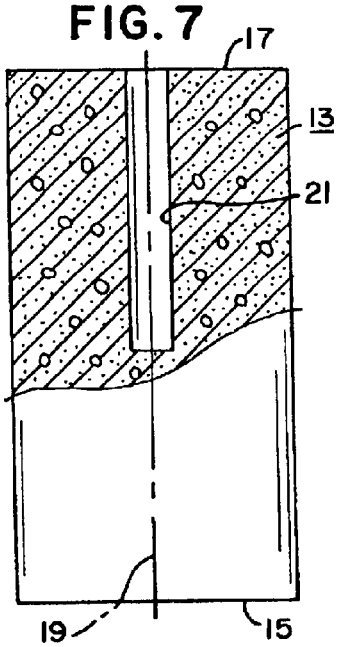
FIG. 7 is a front elevational view of a first or starter pile segment of the segmented piling system of the present invention, with portions thereof broken away for clarity.

The piling system 11 includes starter pile segment 13 having a first or lower end 15, a second or upper end 17, a longitudinal axis 19 extending between the first and second ends 15, 17, and an aperture 21 in the second end 17 extending along the longitudinal axis 19. The aperture 21 preferably extends only halfway toward the first end 15 as clearly shown in FIG. 7, etc. The starter pile segment 13 may be constructed in various manners, out of various materials (e.g., concrete, polymer, etc.) and in various sizes and designs as will now be apparent to those skilled in the art. Thus, for example, the starter pile segment 13 is preferably cast or otherwise constructed as a one-piece, integral unit out of standard 7000 psi (pounds per square inch) concrete as a right cylinder approximately 12 inches (30.48 centimeters) in length and approximately 6 inches (15.24 centimeters) in diameter with the aperture 21 being approximately 6 inches (15.24 centimeters) in length and approximately 0.625 inches (1.5875 centimeters) in diameter.

Figure 9:
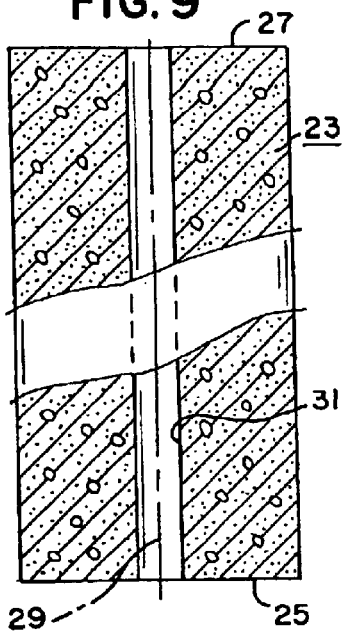
FIG. 9 is a front elevational view of a second or follower pile segment of the segmented piling system of the present invention, with portions thereof broken away for clarity.
Figure 8:
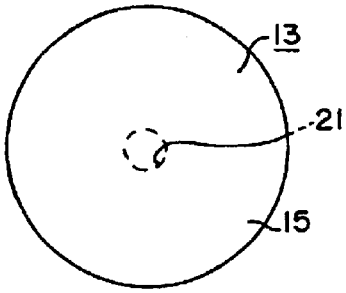
FIG. 8 is a bottom plan view of FIG. 7.
Figure 10:
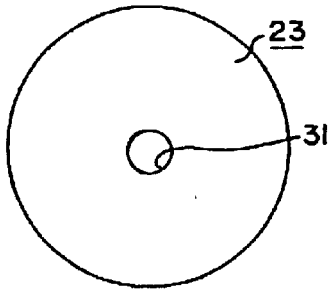
FIG. 10 is a bottom plan view of FIG. 9.
Figure 11:
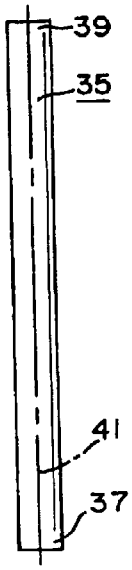
FIG. 11 is a front elevational view of a first embodiment of a connecting rod of the segmented piling system of the present invention.
Figure 12:
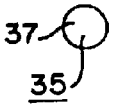
FIG. 12 is a bottom plan view of FIG. 11.

The piling system 11 includes at least one and preferably a plurality of follower pile segments 23 for coacting with the starter pile segment 13 to form an elongated pile P. Each follower pile segment 23 has a first or lower end 25, a second or upper end 27, a longitudinal axis 29 extending between the first and second ends 25, 27, and an aperture 31 extending along the longitudinal axis 29. The aperture 31 may include a first aperture or section in the first end 25 of the follower pile segment 23, and a second aperture or section in the second end 27 of the follower pile segment 23. However, the aperture 31 is preferably a through aperture that extends completely through the follower pile segment 23 from the first end 25 through the second end 27 as clearly shown in FIG. 9, etc.

Thus, the system 11 preferably includes a first follower pile segment 23' for placement on the second end 17 of the starter pile segment 13 (see FIGS. 4–6, 15 and 16), a second follower pile segment 23" for placement on the second end 27 of the first follower pile segment 23' (see FIGS. 5, 6, 15 and 16), perhaps a third follower pile segment 23'" for placement on the second end 27 of the second follower pile segment 23" (see FIGS. 5, 6, 15 and 16), and additional follower pile segments 23 for being stacked on top of the second follower pile segment 23" and one another with the actual number depending on the desired height or depth of the finished pile P (i.e., how far it is desired to drive or force the pile P into the soil S), which, in turn, depends on the condition of the soil S and the like as will be apparent to those skilled in the art.

Each follower pile segment 23 is preferably identical to one another and may be constructed in various manners, out of various materials (e.g., concrete, polymer, etc.) and in various sizes and designs as will now be apparent to those skilled in the art. Thus, for example, each follower pile segment 23 is preferably cast or otherwise constructed as a one-piece, integral unit out of standard 7000 psi (pounds per square inch) concrete as a right cylinder approximately 12 inches (30.48 centimeters) in length and approximately 6 inches (15.24 centimeters) in diameter with the aperture 31 being approximately 12 inches (30.48 centimeters) in length and approximately 0.625 inches (1.5875 centimeters) in diameter.

The piling system 11 includes at least one and preferably a plurality of connecting rods 35, with each connecting rod having a first or lower end 37, a second or upper end 39, and a longitudinal axis 41 extending between the first and second ends 37, 39. Each connecting rod 35 is provided for extending between and axially aligning a pair of pile segments 13, 23 as will hereinafter become apparent.

Figure 3:
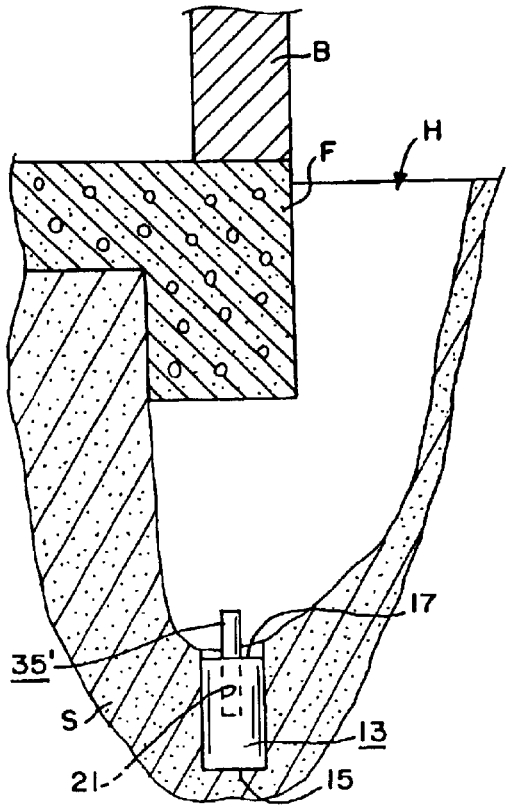
FIG. 3 is a cross-sectional view similar to FIG. 2 but showing further steps of the process of installing a segmented piling system of the present invention.
Figure 4:
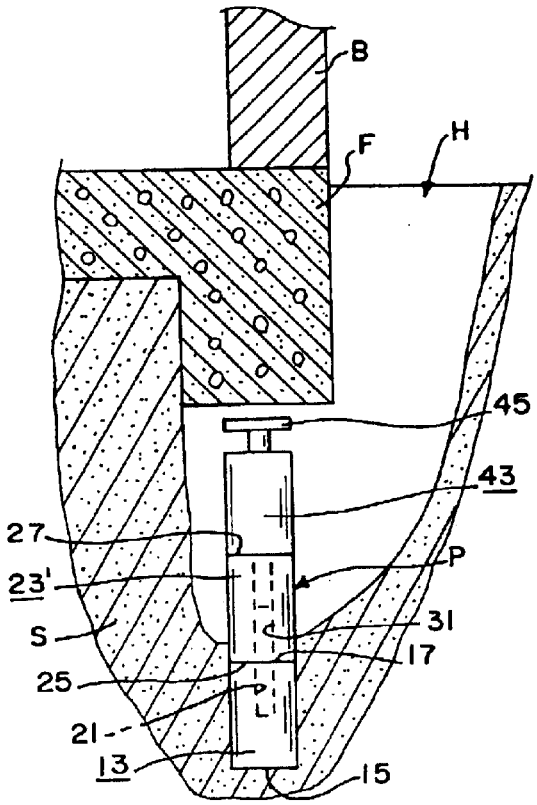
FIG. 4 is a cross-sectional view similar to FIG. 3 but showing further steps of the process of installing a segmented piling system of the present invention.
Figure 5:
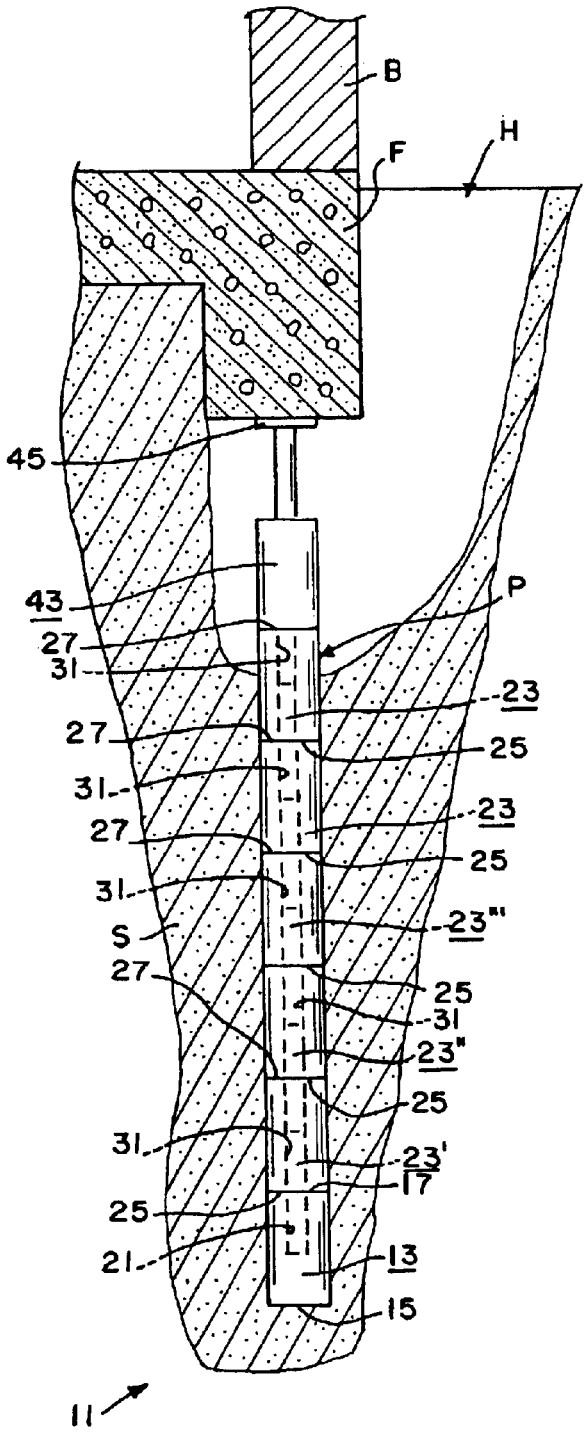
FIG. 5 is a cross-sectional view similar to FIG. 4 but showing further steps of the process of installing a segmented piling system of the present invention.
Figure 6:
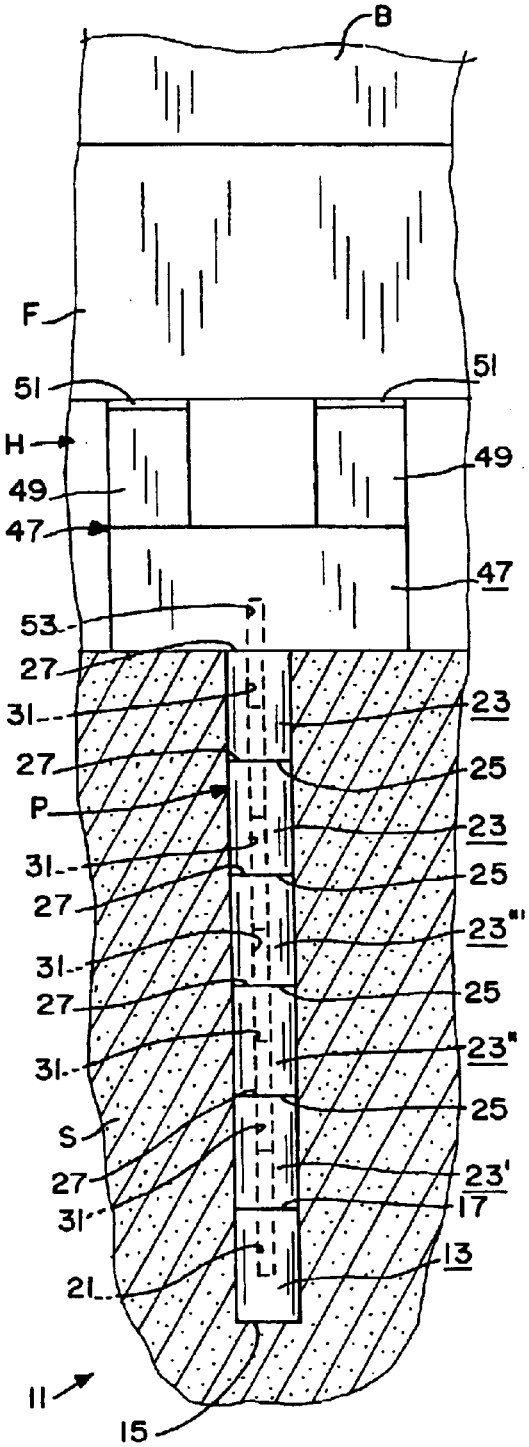
FIG. 6 is a sectional view similar to FIG. 5 but view from the front, and showing further steps of the process of installing a segmented piling system of the present invention.

Thus, the system 11 preferably includes a first connecting rod 35' having a first end 37 for extending into the aperture 21 in the second end 17 of the starter pile segment 13 (see, in general, FIGS. 3 and 15) and a second end 39 for extending into the aperture 31 in the first end 25 of the first follower pile segment 23' (see, in general, FIG. 15), a second connecting rod 35" having a first end 37 for extending into the aperture 31 in the second end 27 of the first follower pile segment 23' (see, in general, FIG. 15), etc., perhaps a third connecting rod 35'" having a first end 37 for extending into the aperture 31 in the second end 27 of the second follower pile segment 23" (see, in general, FIG. 15), etc., and additional connecting rods 35 with each having a first end 37 for extending into the aperture 31 in the first end 25 of a lower follower pile segment 23, etc., with the actual number of connecting rods 35 depending on number of pile segments 23 used in finished pile P.

Each connecting rod 35 is preferably identical to one another and may be constructed in various manners, out of various materials (e.g., steel, polymer, etc.) and in various sizes and designs as will now be apparent to those skilled in the art. Thus, for example, each connecting rod 35 is preferably cut or otherwise formed out of substantially rigid steel rod as a one-piece, integral unit approximately 12 inches (30.48 centimeters) in length and approximately 0.625 inches (1.5875 centimeters) in diameter so as to fit into the apertures 21, 31 in the pile segments 13, 23 with the lower half of the length of each connecting rod 35 extending into the aperture 21, 31 of a lower pile segment 13, 23 and with the upper half of the length of each connecting rod 35 extending into the aperture 31 of an upper pile segment 23.

Figure 13:
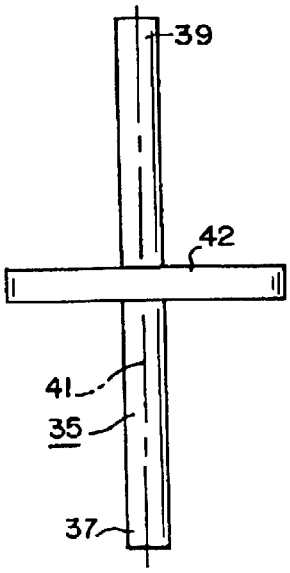
FIG. 13 is a front elevational view of a second embodiment of a connecting rod of the segmented piling system of the present invention.
Figure 14:
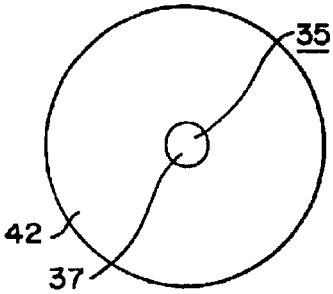
FIG. 14 is a bottom plan view of FIG. 13.
Figure 15:
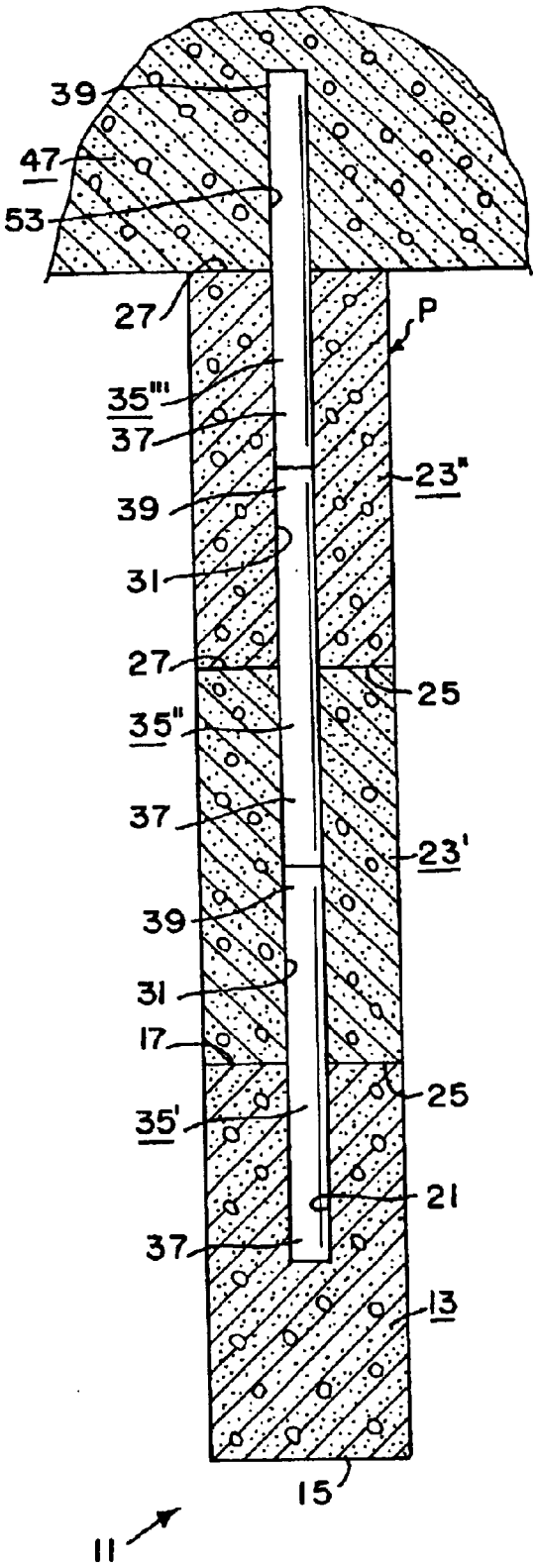
FIG. 15 is an assembled view of a first or starter pile segment of FIG. 7, a plurality of second or follower pile segments of FIG. 9, and a plurality of connecting rods of FIG. 11.
Figure 16:
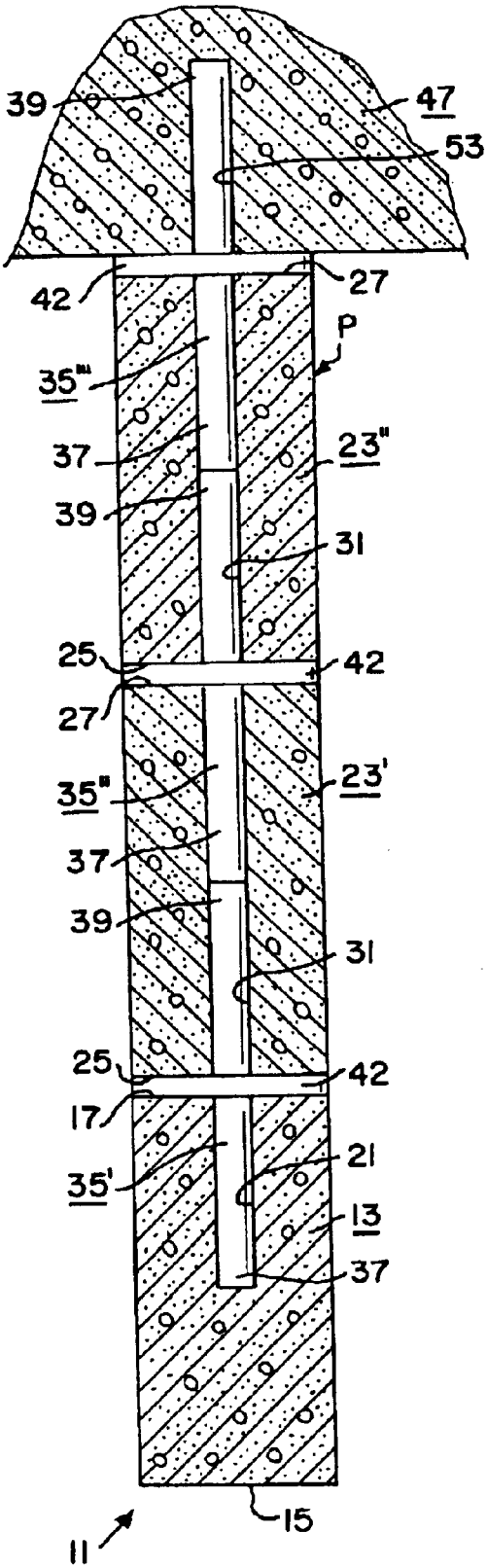
FIG. 16 is an assembled view of a first or starter pile segment of FIG. 7, a plurality of second or follower pile segments of FIG. 9, and a plurality of connecting rods of FIG. 13.

A modified embodiment of the connecting rod 35 is shown in FIGS. 13, 14 and 15, in which the connecting rod 35 includes a flange 42 positioned half way between the first and second ends 37, 39 thereof. The flange 42 may be formed as a integral part of the remainder of the connecting rod 35, or as a separate piece welded or otherwise secured to the shaft of the connecting rod 35, etc.

Figure 1:
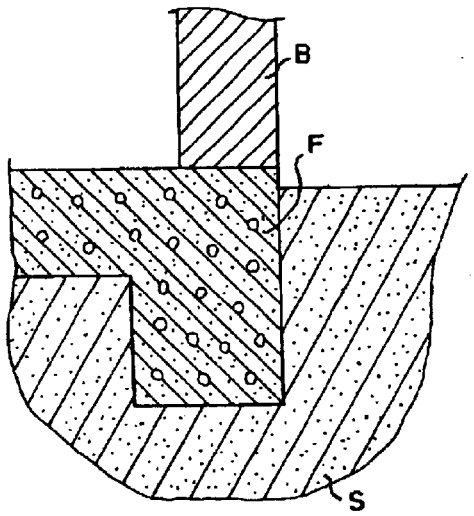
FIG. 1 is a somewhat diagrammatic, cross-sectional view of the foundation and adjacent features of an existing structure.
Figure 2:
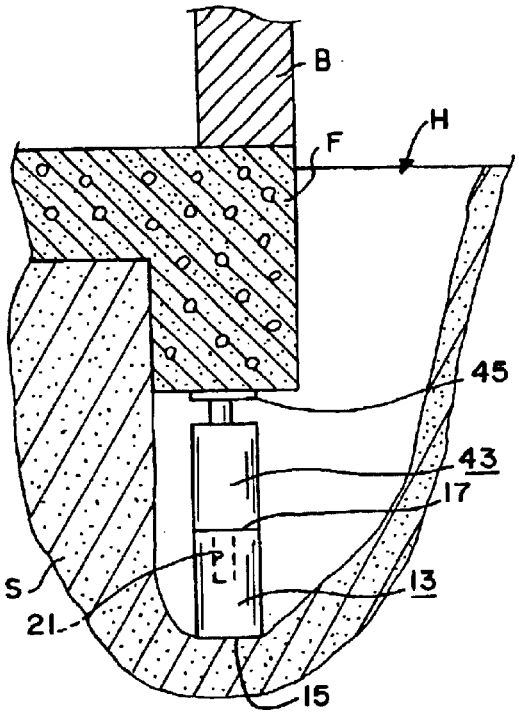
FIG. 2 is a cross-sectional view similar to FIG. 1 but showing initial steps of the process of installing a segmented piling system of the present invention.

The preferred process of installing a segmented piling system 11 for supporting an existing building B or other structure on unstable soil S usually starts with an engineering study to determine the proper number, locations and sizes of piling systems 11 needed for the specific building B on the specific soil S. Next, a hole H is excavated to expose the bottom of the foundation F of the building B at the location it is desired to install a segment piling system 11 (see FIGS. 2–6). The hole H is excavated beneath the foundation F a distance sufficient to allow a worker to place a jack 43, or other means for applying force, and at least one pile segment 13, 23 (see FIG. 2). Once the hole H is excavated, a worker places the starter pile segment 13 in the hole H on the soil S at the spot beneath the foundation F that it is desired to form the pile P. The jack 43 or other such means is placed between the second end 17 of the starter pile segment 13 and the bottom of the foundation F (see FIG. 2). The jack 43 may be of various types, etc., but is preferably a pneumatic or hydraulic construction type jack with an electric pump, etc., such as disclosed in Willcox, U.S. Pat. No. 5,505,561, issued Apr. 9, 1996, and in Knight, U.S. Pat. No. 5,288,175, issued Feb. 22, 1994 (see jack 8), both of which are hereby incorporated herein by reference. The jack 43 is then activated to drive or force the starter pile segment 13 into the soil S until the second end 17 of the starter pile segment 13 is adjacent the bottom of the hole H. Next, the jack 43 is deactivated to withdraw the jack head 45 away from the bottom of the foundation F, and allow the worker to move the jack 43 from the starter pile segment 13 and insert the first end 37 of the first connecting rod 35' into the aperture 21 in the second end 17 of the starter pile segment 13 (see FIG. 3). The worker can then place the first end 25 of the first follower pile segment 33' onto the second end 17 of the starter pile segment 13 with the second end 39 of the first connecting rod 35' being inserted into the aperture 31 in the first end 25 of the first follower pile segment 33' (see FIG. 4), whereby the longitudinal axes 19, 29, 41 of the starter pile segment 13, first follower pile segment 23' and first connecting rod 35' will be aligned, collinear and concentric with one another. The jack 43 is then placed between the second end 27 of the first follower pile segment 23' and the bottom of the foundation F, and then reactivated to drive or force the combined first follower pile segment 23', first connecting rod 35', and starter pile segment 13 into the soil S until the second end 27 of the first follower pile segment 23' is adjacent the bottom of the hole H. Next, the jack 43 is deactivated to withdraw the jack head 45 away from the bottom of the foundation F, and allow the worker to move the jack 43 from the first follower pile segment 23' and insert the first end 37 of the second connecting rod 35" into the aperture 31 in the second end 27 of the first follower pile segment 13'. The worker can then place the first end 25 of the second follower pile segment 23" onto the second end 27 of the first follower pile segment 23' with the second end 39 of the second connecting rod 35" being inserted into the aperture 31 in the first end 25 of the second follower pile segment 23", whereby the longitudinal axes 19, 29, 41 of the starter pile segment 13, first follower pile segment 23', first connecting rod 35', second follower pile segment 23", and second connecting rod 35" will be aligned, collinear and concentric with one another. The jack 43 is then placed between the second end 27 of the second follower pile segment 23" and the bottom of the foundation F, and then reactivated to drive or force the combined second follower pile segment 23", second connecting rod 35", first follower pile segment 23', first connecting rod 35', and starter pile segment 13 into the soil S until the second end 27 of the second follower pile segment 23" is adjacent the bottom of the hole H. These steps can be repeated with additional follower pile segments 23 and additional connecting rods 35 until the pile P is driven into the soil S the desired depth or until the pile P reaches a point of refusal (e.g., is driven to solid soil, bed rock, etc.). The jack 43 is then removed from the hole H and a piling cap 47 may be installed on the second end 27 of the last follower pile segment 23 and joined to the bottom of the foundation F with support blocks 49 and/or shim plates 51 if needed to level and support the building B and interconnect all components. The piling cap 47 preferably has an aperture 53 in the bottom thereof so that a connector rod 35 can be used to align and connect the pile P and piling cap 47. That is, after the pile P is driven into the soil S the desired depth, etc., and the jack 43 is removed or deactivated, the first end 37 of a final or last connector rod 35 is inserted into the aperture 31 in the second end 27 of the final or last follower pile segment 23, and the piling cap 47 is installed on the second end 27 of the final or last follower pile segment 23 with the second end 39 of the final or last connector rod 35 extending into the aperture 53 in the piling cap 47. The piling cap 47 and support blocks 49 may be constructed in various manners, out of various materials (e.g., concrete, polymer, etc.) and in various sizes and designs as will now be apparent to those skilled in the art. Thus, for example, the piling cap 47 is preferably cast or otherwise constructed as a one-piece, integral unit out of standard 7000 psi (pounds per square inch) concrete as a block like member having the aperture 53 formed or drilled into the bottom thereof of a size to accept the second end 37 of a rigid rod 35. Each support block 49 may be cast or otherwise constructed as a one-piece, integral unit out of standard 7000 psi (pounds per square inch) concrete as a block like member. Each shim plate 51 may be machined or otherwise formed out of metal in a typical wedge-like shape for allowing fine adjustment of the connection between the bottom of the foundation F and the top of the pile P as will now be apparent to those skilled in the art.

As thus constructed and used, the preferred embodiment of the present invention provides a system and process for installation of segmented piling system for the purpose of supporting a structure in unstable soil, in which: (1) a hydraulic system can be used to drive a concrete starter cylinder below the foundation of the structure being supported, and install a steel connecting rod into the starter cylinder that protrudes above the starter cylinder; (2) the next segmented cylinder is placed upon the connecting rod that protrudes from the starter cylinder and the two cylinders are then hydraulically driven into the soil for a controlled distance; and (3) this process continues until the segmented pile reaches a point of refusal, at which time a connecting rod is placed into the last installed cylinder and a piling cap is installed upon that connecting rod for the purpose of leveling and supporting the structure and interconnecting all components.

Although the present invention has been described and illustrated with respect to preferred embodiments and preferred uses therefor, it is not to be so limited since modifications and changes can be made therein which are within the full intended scope of the invention.

What is claimed is:

1. A segmented piling system for supporting a structure on unstable soil, said piling system comprising:

(a) a starter pile segment having a first end, a second end, a longitudinal axis extending between said first and second ends, and an aperture in said second end extending along said longitudinal axis;

(b) a follower pile segment having a first end, a second end, a longitudinal axis extending between said first and second ends, and an aperture in said first end extending along said longitudinal axis; said follower pile segment having a diameter; said aperture in said first end of said follower pile segment having a diameter; said diameter of said aperture in said first end of said follower pile segment being no greater than 17% of the diameter of said follower pile segment; and (c) a first connecting rod having a first end for extending into said aperture in said second end of said starter pile segment, and having a second end for extending into said aperture in said first end of said follower pile segment.

2. The piling system of claim 1 in which said follower pile segment has a second aperture in said second end thereof extending along said longitudinal axis thereof; said second aperture in said second end of said follower pile segment having a diameter; said diameter of said second aperture in said second end of said follower pile segment being no greater than 17% of the diameter of said follower pile segment.

3. The piling system of claim 2 in which is included:

(a) a second follower pile segment having a first end, a second end, a longitudinal axis extending between said first and second ends, and an aperture in said first end extending along said longitudinal axis thereof; said aperture in said first end of said second follower pile segment having a diameter; said diameter of said aperture in said first end of said second follower pile segment being no greater than 17% of the diameter of said second follower pile segment; and (b) a second connecting rod having a first end for extending into said aperture in said second end of said follower pile segment, and having a second end for extending into said aperture in said first end of said second follower pile segment.

4. The piling system of claim 3 in which said first and second connecting rods are formed out of substantially rigid steel rod.

5. The piling system of claim 1 in which said first connecting rod is formed out of substantially rigid steel rod.

6. A segmented piling system for supporting a structure on unstable soil, said piling system comprising:

(a) a starter pile segment having a first end, a second end, a longitudinal axis extending between said first and second ends, and an aperture in said first end extending along said longitudinal axis; said starter pile segment having an outside diameter; said aperture in said first end of said starter pile segment having an inside diameter; said inside diameter of said aperture in said first end of said starter pile segment being approximately 10% of the outside diameter of said starter pile segment;

(b) a plurality of follower pile segments; each of said follower pile segments having a first end, a second end, a longitudinal axis extending between said first and second ends, a first aperture in said first end extending along said longitudinal axis, and a second aperture in said second end extending along said longitudinal axis; said follower pile segments having an outside diameter; said first and second apertures in each of said follower pile segments having an inside diameter; said inside diameter of said apertures in said first and second ends of each said follower pile segment being approximately 10% of the outside diameter of said follower pile segments; and (c) a plurality of a solid connecting rods for interconnecting said pile segments; each of said rods having a first end for extending into said aperture in said second end of said starter pile segment or in said first aperture in said first end of one of said follower pile segments, and having a second end for extending into said second aperture in one of said follower pile segments, each of said rods having a diameter approximately equal to the diameter of said apertures in said pile segments.

7. A process of installing a segmented piling system for supporting a structure on unstable soil, said process comprising the steps of:

(a) providing a starter pile segment having a first end, a second end, a longitudinal axis extending between said first and second ends, and an aperture in said second end extending along said longitudinal axis; the inside diameter of said aperture in said second end of said starter pile segment being no greater than 17% of the outside diameter of said starter pile segment;

(b) driving said first end of said starter pile segment into the soil adjacent the structure;

(c) providing a first connecting rod having a first end and a second end;

(d) inserting said first end of said connecting rod into said aperture in said second end of said starter pile segment;

(e) providing a first follower pile segment having a first end, a second end, a longitudinal axis extending between said first and second ends, and an aperture in said first end extending along said longitudinal axis; the inside diameter of said aperture in said first end of said first follower pile segment being no greater than 17% of the outside diameter of said first follower pile segment;

(f) placing said first end of said first follower pile segment onto said second end of said starter pile segment with said second end of said first connecting rod extending into said aperture in said second end of said first follower pile segment; and (g) then driving said first end of said first follower pile segment into the soil.

8. The process of claim 7 in which said first follower pile segment has an aperture in said second end thereof extending along said longitudinal axis thereof, the inside diameter of said aperture in said second end of said first follower pile segment being no greater than 17% of the outside diameter of said first follower pile segment; and in which said process further comprising the steps of:

(a) providing a second follower pile segment having a first end, a second end, a longitudinal axis extending between said first and second ends, and an aperture in said first end extending along said longitudinal axis; the inside diameter of said aperture in said first end of said second follower pile segment being no greater than 17% of the outside diameter of said second follower pile segment;

(b) providing second connecting rod having a first end and a second end;

(c) inserting said first end of said second connecting rod into said aperture in said second end of said first follower pile segment;

(d) placing said first end of said second follower pile segment onto said second end of said first follower pile segment with said second end of said second connecting rod extending into said aperture in said first end of said second follower pile segment; and (e) then driving said first end of said second follower pile segment into the soil.

9. A process of installing a segmented piling system for supporting a structure on unstable soil, said process comprising the steps of:

(a) providing a starter pile segment having a first end, a second end, a longitudinal axis extending between said first and second ends, and an aperture in said second end extending along said longitudinal axis; the inside diameter of said aperture in said second end of said starter pile segment being approximately 10% of the outside diameter of said starter pile segment;

(b) providing first and second follower pile segments; each of said follower pile segments having a first end, a second end, a longitudinal axis extending between said first and second ends, an aperture in said second end extending along said longitudinal axis, and an aperture in said first end extending along said longitudinal axis; the inside diameter of said apertures in said first and second ends of each of said follower pile segments being approximately 10% of the outside diameter of said follower pile segments;

(c) providing first, second and third solid connecting rods, each of said connecting rods having a first end and a second end; said first and second ends of each of said connecting rods having an outside diameter approximately equal to the inside diameters of said apertures in said pile segments;

(d) driving said starter pile segment into the soil beneath the structure;

(e) inserting said first end of said first connecting rod into said aperture in said second end of said starter pile segment;

(f) placing said first end of said first follower pile segments onto said second end of said starter pile segment with said second end of said first connecting rod extending into said aperture in said first end of said first follower pile segment;

(g) then driving said first end of said first follower pile segments into the soil;

(h) inserting said first end of said second connecting rod into said aperture in said second end of said first follower pile segment;

(i) placing said first end of said second follower pile segment onto said second end of said first follower pile segment with said second end of said second connecting rod extending into said aperture in said first end of said second follower pile segments;

(j) then driving said second one of said follower pile segments into the soil; and (k) inserting said first end of said third connecting rod into said aperture in said second end of said second follower pile segment.

* * * * *